United States Patent [19]

Johnson

[11] 4,019,423

[45] Apr. 26, 1977

[54] AUTOMATIC OR SEMI-AUTOMATIC FIREARM

[76] Inventor: James H. Johnson, 818 S. Willow Ave., Tampa, Fla. 33606

[22] Filed: Oct. 19, 1970

[21] Appl. No.: 82,113

Related U.S. Application Data

[62] Division of Ser. No. 780,034, Nov. 28, 1968, abandoned.

[52] U.S. Cl. ..... 89/178; 89/14 E; 89/197

[51] Int. Cl.[2] ..... F41C 21/18

[58] Field of Search ..... 89/14 E, 159, 162, 177, 89/178, 191 R, 192, 193, 194, 195, 196, 197

[56] References Cited

UNITED STATES PATENTS

| | | | |
|---|---|---|---|
| 459,828 | 9/1891 | Maxim | 89/14 E |
| 834,753 | 10/1906 | Reifgraber | 89/14 E |
| 2,776,602 | 1/1957 | Sturtevant | 89/196 |
| 2,956,481 | 10/1960 | Barr et al. | 89/193 |

FOREIGN PATENTS OR APPLICATIONS

| | | | |
|---|---|---|---|
| 1,166,053 | 3/1964 | Germany | 89/14 E |
| 605,136 | 7/1948 | United Kingdom | 89/194 |
| 147,371 | 7/1920 | United Kingdom | 89/192 |

*Primary Examiner*—Stephen C. Bentley

[57] ABSTRACT

A stable automatic or semi-automatic firearm having a differential recoil system in which an open bolt has a designed mass and closing velocity to impact and drive a reciprocating barrel forwardly without rebound and remain locked to the barrel during the period when there is high firing pressure in the barrel. Since the bolt supports the cartridge during the time of high pressure, the cartridge is prevented from prematurely being extracted and rupturing; and since recoil momentum is utilized in arresting and returning the bolt, stability of the firearm is improved.

7 Claims, 17 Drawing Figures

James H. Johnson
INVENTOR.

BY Stefan M. Stein
ATTORNEY

James H. Johnson
INVENTOR.

BY Stefan M. Stein
ATTORNEY

James H. Johnson
INVENTOR.

BY Stefan M. Stein
ATTORNEY

James H. Johnson
INVENTOR.

BY Stefan M. Stein
ATTORNEY

AUTOMATIC OR SEMI-AUTOMATIC FIREARM

This is a division of application Ser. No. 780,034, filed Nov. 28, 1968 now abandoned.

This invention relates to a firearm; more particularly this invention relates to a firearm of the automatic or semiautomatic type.

As is well known, recoil of any gun increases as the gun, or that part of it which recoils, is decreased in weight or the power of the ammunition that is fired is increased. The physical reason is that a given cartridge will develop a characteristic amount of recoil momentum, given a particular length of barrel, regardless of the type of the gun in which it is fired (excluding the "recoilless rifle" type). This recoil momentum results in a kinetic energy of recoil or recoil energy which is proportionate to the square of the recoil momentum and varies inversely with the mass of the recoiling part. In other words, doubling the recoil momentum by increasing the power of the cartridge will quadruple the recoil energy of the gun. Reducing the recoiling mass on the other hand by fifty percent will double the recoil energy. Therefore, since reducing the weight of a gun and increasing the power of the ammunition substantially increases the gun's recoil, recoil is a critical problem in stability of lightweight guns when firing powerful ammunition.

One system developed to overcome this problem is called a differential recoil system. In one variation of this system the barrel and breech are forced rearwardly against a recuperator spring before firing and held in this position by a catch or sear. After the gun is loaded and the sear released, the barrel and breech are then driven forwardly by the spring. The recuperator spring is designed to impute to the masses of the barrel and breech a velocity that would be equal to one-half that which would be attained in a conventional gun. In other words, the spring would give the barrel and breech a velocity to attain a forward momentum equal to one-half of the normal recoil momentum for the particular ammunition utilized. This forward momentum is attained just prior to the barrel and breech reaching their fully forward or battery position. At this point, the gun is fired. Since the moving masses at firing have a forward momentum approximately equal to one-half of the recoil momentum which the cartridge is capable of producing, one-half of the recoil momentum produced by the cartridge is utilized in arresting the forward motion of the breech and barrel, and the remaining half is utilized in throwing them rearwardly where they are once again caught and held by the sear. It is important to note that at no time do the recoiling masses of the barrel and breech contain more than one-half the normal recoil momentum which would be attained by a conventional gun of the same weight in its recoiling parts. This is important since the recoil energy is proportionate to the square of the momentum of the recoiling parts. Thus, in terms of recoil energy, at no time does the barrel and breech contain more than one-fourth of the recoil energy of an equivalent conventional gun. In addition, rather than impacting directly on the firearm's frame, the recoil momentum is distributed during the movement of the barrel and bolt. The stability of the gun is thereby greatly improved.

In automatic firearms this system has been generally developed along two different basic approaches. In the first approach, illustrated by U.S. Pat. No. 2,146,185, issued to V. Holek, a conventional automatic weapon mechanism is mounted in a weapon frame in a manner which permits the barrel a limited amount of motion along the axis of the weapon. The weapon is fired from the open bolt position, and employs a conventional mechanically locked bolt. In the Holek weapon, which is gas operated in the usual manner, an operating rod receives energy from a gas system and subsequently unlocks and opens the bolt in the customary manner. This weapon obtains the effect of differential recoil by permitting the barrel to reciprocate within the frame without metal-to-metal impact with the frame, the barrel being first moved forwardly by the closing impact of operating rod and bolt, and then arrested and moved rearwardly by the momentum produced by firing before an impact with the frame can occur. Weapons of this type are entirely conventional as to the method of locking and the method of obtaining energy for operation, and differ from conventional automatic weapons in having provision for the breech mechanism and barrel to oscillate over a short distance within the frame of the weapon while firing. This approach permits the weapon to attain the stability resulting from differential recoil, and does not require special types of ammunition or ammunition treatment, but has the disadvantage of being necessarily complex in construction. The second approach which is frequently used is described in U.S. Pat. No. 1,144,185, issued to Rheinhold Becker. In this system the barrel is fixed to the weapon frame and does not participate in the recoil motion. A simple blowback type of bolt is used, which is not mechanically locked to the barrel at any time. The weapon is fired from the open bolt position, and the cartridge is fired just before reaching the fully forward position in the chamber. The forward motion of the cartridge case and the blowback bolt is then first arrested by the momentum caused by firing, and then accelerated to the rear, providing differential recoil in exactly the same manner previously described, except the bolt is the only reciprocating member. This type of weapon requires the use of a special over-length chamber, and a specially shaped cartridge case which permits the front portion of the bolt to enter the chamber with the cartridge. Since the cartridge case and bolt must be able to move within the chamber during the period when the propellant gas pressure is high, the cartridge case must be heavily lubricated. If this is not done, the forward portion of the cartridge case will adhere to the wall of the chamber because of the pressure, while the rear of the case will be forced to the rear with the bolt, causing a case separation and consequently a major malfunction.

It may be seen from the foregoing that automatic weapons which utilize the differential recoil principle have either the disadvantage of being complex in construction or the disadvantage of requiring the use of special, heavily lubricated ammunition. These disadvantages have prevented the success of various attempts to apply the principle of differential recoil to automatic small arms of a type intended for individual use, although the advantages of differential recoil in providing mildness of recoil effects and stability in fully automatic fire are highly desirable in this class of weapons.

As is well known, the use of low powered ammunition in an automatic weapon permits the use of a simple blowback mechanism in which the bolt is the only major operating part, and in which the bolt serves to lock the action effectively through inertia, while, because of blowback action, it also serves as the operating energy system. In weapons employing such low powered ammunition, the use of lubricated ammunition is not required, and the weapon accordingly very simple and reliable. The use of high pressure ammunition, of the type usually necessary for rifles, machine guns and automatic cannon, prevents the use of the simple blowback system of operation, and requires either the special ammunition and heavy ammunition lubrication common to the system described previously, or the use of a conventional, mechanically locked breech mechanism, combined with a separate operating energy system. In the latter case, the weapon becomes complex in design and manufacture, and in general, less reliable than the elementary blowback weapon which uses low powered cartridges. Attempts have been made to produce a gun which can fire high powered ammunition without the complicity of a mechanically locked breech mechanism, but have been unsuccessful.

Accordingly, it is an object of this invention to provide an automatic or semi-automatic firearm having an operating system which can safely utilize conventional, unlubricated high-pressure ammunition in conjunction with an elementary, unlocked blowback bolt.

Another object is to provide a stable automatic or semi-automatic firearm.

Still another object is to provide an automatic semi-automatic firearm having a system of operation in which the bolt and barrel of the firearm move together during a period of dangerous barrel chamber pressure to eliminate or greatly reduce the tendency of the cartridge case to be ruptured by simultaneous adherence of the front portion of the case to the wall of the chamber while the back portion is forced to the rear by gas pressure.

A further object is to provide an automatic or semi-automatic firearm having a system of operation in which the bolt has a designed momentum to drive the barrel forwardly after the bolt closes against the barrel such that one-half of the firing recoil momentum is utilized in arresting the forward motion of the bolt and one-half is utilized in returning the bolt to its rearward position.

A still further object is to provide an automatic or semi-automatic firearm having a system of operation in which a barrel spring is designed to arrest the forward movement of the barrel and return it to its rearward position.

Another object is to provide an automatic or semi-automatic firearm having a system of operation in which the barrel has a natural frequency of vibration against the barrel spring such that the barrel is returned rearwardly simultaneously with the rearward stroke of the bolt.

Another object is to provide an automatic or semi-automatic firearm having a system of operation in which a propellant gas system arrests the forward movement of the barrel and returns it to its rearward position.

Another object is to provide an automatic or semi-automatic firearm having a system of operation in which propellant gases are trapped between the barrel and the forward end of the frame to assist in arresting the forward movement of the barrel and then moving the barrel rearwardly.

Another object is to provide an automatic or semi-automatic firearm having a propellant gas system for closed bolt firing to move the barrel rearwardly with the bolt during a period of high firing pressure.

Another object is to provide an automatic or semi-automatic firearm having a system of operation in which the chamber of the barrel is fluted to prevent the cartridge from adhering to the barrel's chamber.

Another object is to provide an automatic or semi-automatic firearm having a system of operation with the bolt and barrel having a low coefficient of restitution or non-resilient impact.

Another object is to provide an automatic or semi-automatic firearm having a system of operation which is easy to field strip and repair.

Another object is to provide an automatic or semi-automatic firearm having an operating system which does not malfunction.

Another object is to provide a firearm having a system of operation which is unusually simple but exceedingly effective.

Another object is to provide an automatic or semi-automatic firearm which is practical and economically feasible to manufacture.

Other objects of the invention will in part be obvious and will in part appear hereinafter.

In accordance with these objects, the invention comprises an automatic or semi-automatic firearm. In a preferred embodiment, the firearm contains a frame which houses a reciprocally mounted barrel and bolt, both of which reciprocate along the frame's longitudinal axis. In a cocked position, the bolt is held to the rear of the frame against the force of a bolt driving spring by a sear. When the firearm is to be fired, the sear is triggered to release the bolt. At this time, the bolt drives forwardly under the influence of the drive spring, receives a cartridge and then inserts the cartridge into the barrel. When the bolt closes against the barrel and the cartridge is finally seated, a firing pin protruding from the face of the bolt fires the cartridge. Simultaneously with the firing of the cartridge, the bolt's mass and velocity is such that as it contacts or impacts against the barrel it has a forward momentum equal to approximately one-half of the firing recoil momentum. Upon impacting with the barrel, the momentum imparted to the bolt causes the barrel to also move forwardly against a barrel spring which normally biases the barrel in a rearward position. The impact of the bolt on the barrel tends to be of a type known as low coefficient of restitution or non-resilient impact. In this type of impact, the bolt and barrel do not tend to rebound after impact, but rather remain in contact.

Thus, the bolt and barrel move together immediately after the cartridge is fired during the dangerous period when there is high pressure in the barrel. Since the bolt at this time is effectively locked to the barrel, the bolt supports the rear of the cartridge case, and the case is thereby prevented from being stretched unacceptably or ruptured because of the high pressure. After the bolt and barrels have moved forwardly for a short distance the bolt begins to decelerate in its forward movement due to the gas pressure in the barrel acting on the bolt through the rear of the cartridge case. The bolt is eventually stopped by the gas pressure and then accelerated rearwardly by this pressure and by the bolt drive spring, which had been over extended due to the forward momentum of the bolt. Although the bolt moves rearwardly at this time, the barrel continues in its forward movement causing the bolt and barrel to move apart in opposite directions. Obviously, at this point, the locking effect between the bolt and barrel is at an end. This non-mechanical locking effect is properly designed such that the bolt and barrel remain together until the pressure in the barrel's chamber is sufficiently reduced to enable the cartridge case to be extracted without being stretched or ruptured. At the end of the locking effect, the barrel continues its forward movement for a short distance until arrested by the barrel compression spring. After which, the barrel is thrust rearwardly by the barrel spring until coming to rest in its initial rearward position. The bolt meanwhile continues to move rearwardly under the influence of the gas pressure and bolt drive spring. As it moves rearwardly, it extracts and ejects the cartridge case from the firearm in a customary manner. If the firearm is of the semi-automatic variety the bolt may be held to the rear by the sear upon reaching its full recoil position, in which case, the firearm is once again ready to be fired. However, if the firearm is fully automatic, the bolt is simply permitted to return and repeat the cycle.

When in operation, the gun is extremely stable. One-half of the recoil momentum produced in firing the cartridge is utilized in arresting the forward motion of the bolt and the other half of the recoil momentum is utilized in returning the bolt to its initial position. Thus, since the forward movement of the barrel is cushioned against the barrel spring, neither the bolt nor the barrel have metal impact with the frame and the frame is therefore only subjected to spring forces. Being subjected only to spring forces, the frame and operator of the firearm receive a low and relatively constant force rather than a succession of impacts as would be the case without the differential recoil effect. Thus stability is improved.

In a first modification of this system, the barrel mass and the barrel spring rate are adjusted so as to cause the barrel to have a particular natural frequency of vibration in conjunction with the barrel spring. This frequency of vibration is designed such that the time period corresponding to one-half of a complete oscillation is approximately equal to the duration of the pressure period within the chamber of the weapon. Thus, when the system is fired, the spring exerts a rearward force on the barrel closely equal to but in an opposite direction to the forces tending to move the barrel forwardly. When the bolt moves rearwardly the spring also moves the barrel rearwardly. The result is that the time limit of the locking effect will be extended as the barrel will not only travel forwardly with the bolt but will also reverse and move with the bolt during its rearward stroke. Since the bolt supports the cartridge case over a longer period of time the tendency of the cartridge to stretch is even further reduced.

In a second modification, muzzle gases, in addition to the barrel spring of the primary embodiment are utilized to retard and arrest the forward movement of the barrel. By so acting on the barrel, the muzzle gases effectively retard the separation of the bolt and barrel and prolong the locking effect of the bolt and barrel. Because of this, similar to the previous modification in which the barrel has a particular frequency of vibration against the barrel spring, the tendency of the cartridge case to stretch is substantially lessened.

In a third modification, a gas system is utilized in place of a barrel spring. When the cartridge is fired, propellant gases are passed into a compression chamber between the barrel and the frame. These gases, acting similar to the barrel spring, first arrest the forward movement of the barrel and then drive the barrel to its rearward position.

In still another modification, the system is arranged for closed bolt firing. In this modification the barrel is initially in a forward position and moves rearwardly with the bolt when a cartridge is fired. The advantage of the differential recoil system is lost; but since the bolt still supports the cartridge during the period of high pressure, this system is beneficial when closed bolt firing is desired.

Finally, the barrel's chamber may be fluted at the forward end so as to permit gas on the outside of the cartridge case to counteract the gas pressure within the cartridge case to still further eliminate any tendency of the cartridge to stretch as the bolt and barrel begin to separate.

The invention accordingly comprises the features of construction, combination of elements and arrangement of parts which will be exemplified in the construction hereinafter set forth, and the scope of the invention will be indicated in the claims.

For a fuller understanding of the nature and objects of the invention, reference should be had to the following detailed description taken in connection with the accompanying drawings in which.

Figure 1:
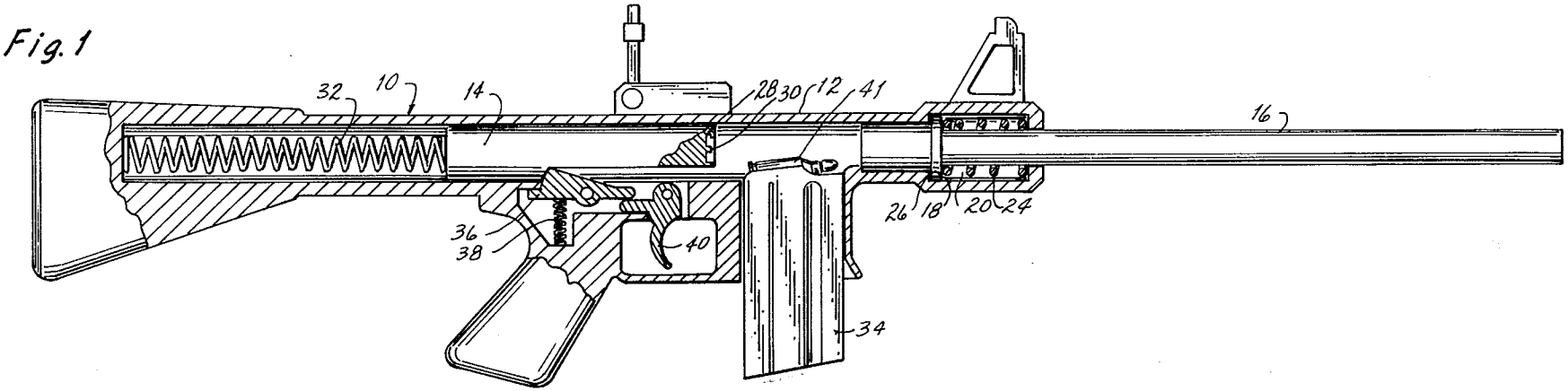
FIG. 1 is a partial cross-section elevation view of the firearm comprising the invention.

FIGS. 3, 4, 5, 6, 7, and 8 are cross-sectional views showing a sequential operation of the firearm of FIG. 1.

Figure 9:
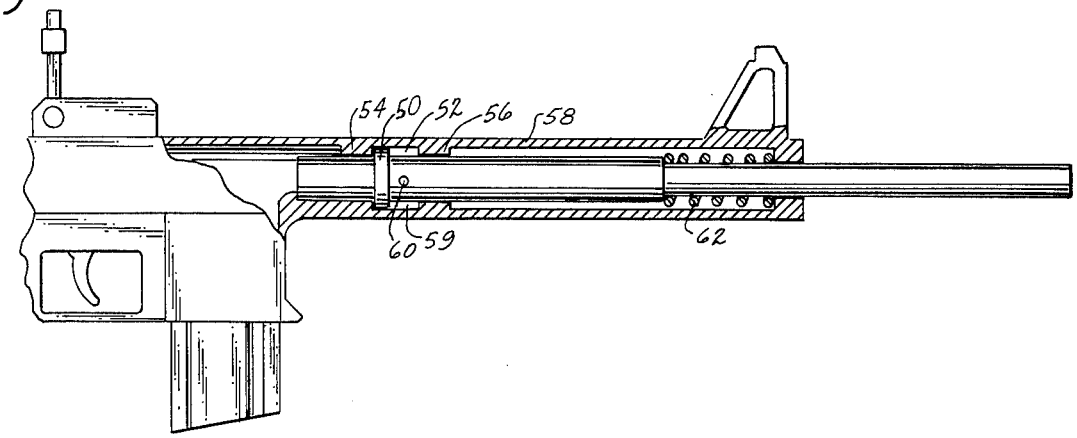

FIG. 9 shows a partial cross-sectional elevation view of the firearm modified with a concentric gas system.

Figure 10:
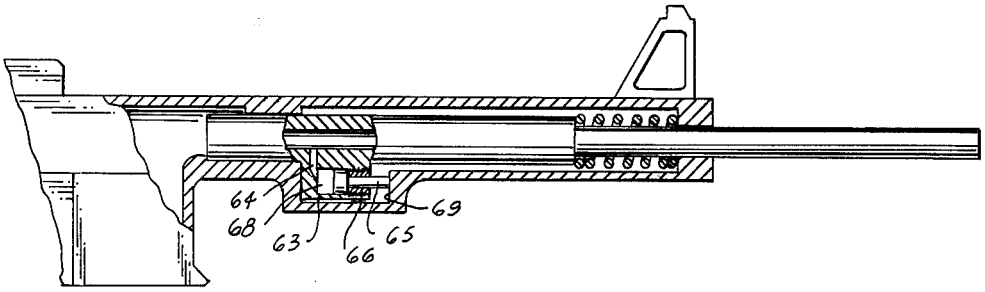

FIG. 10 is a partial cross-sectional elevation view of the firearm modified with an offset gas system.

Figure 11:
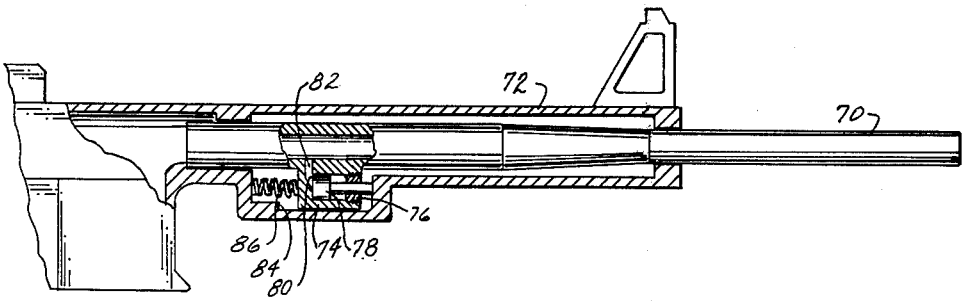

FIG. 11 is a cross-sectional elevation view of the firearm modified to enable the bolt to be fired from a closed position.

Figure 12:
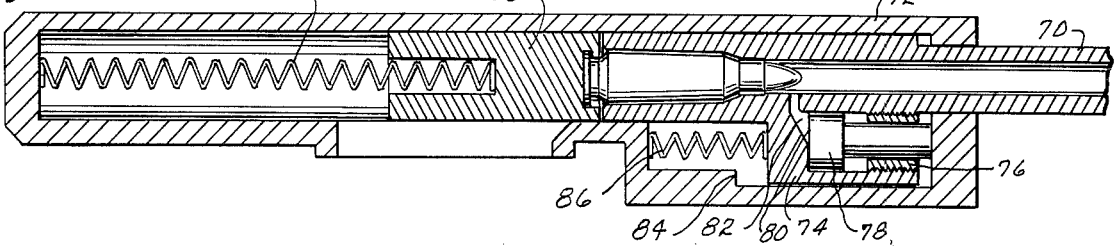
Figure 13:
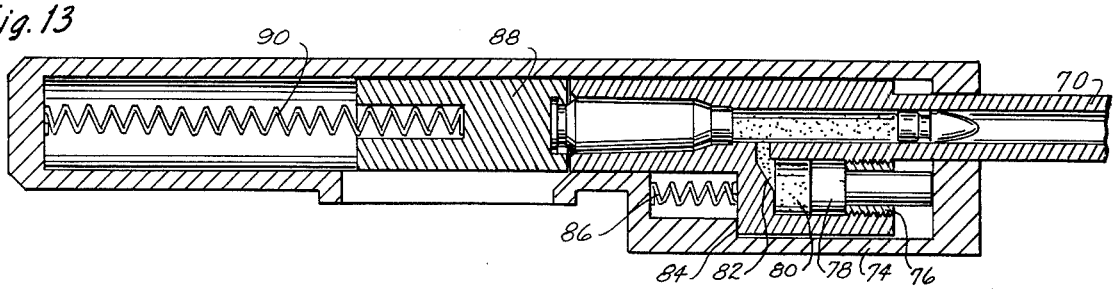
Figure 14:
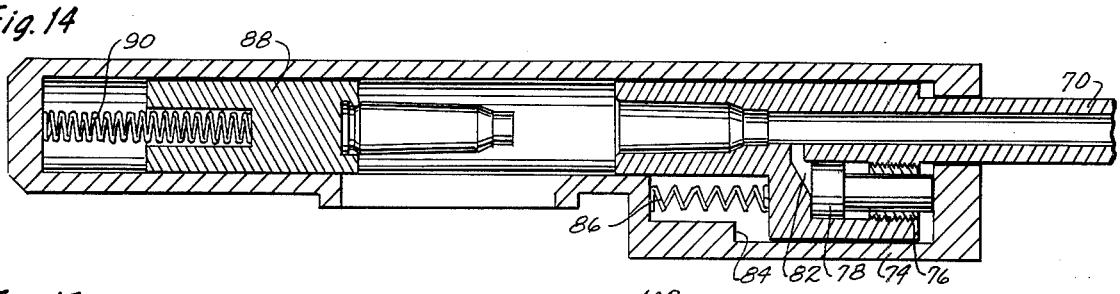

FIGS. 12, 13 and 14 are cross-sectional views showing a sequential operation of the firearm of FIG. 11.

Figure 15:
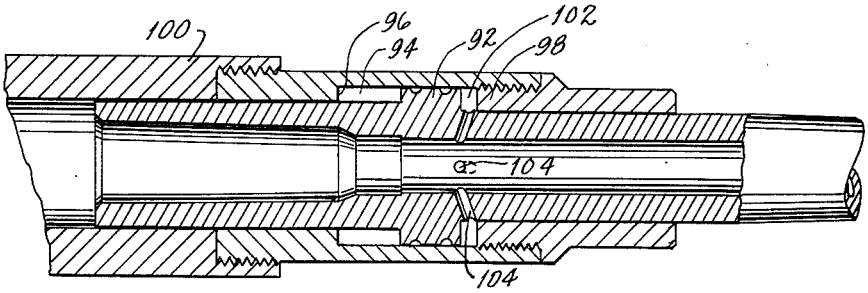

FIG. 15 is a cross-sectional elevation view of the firearm of FIG. 11 modified with an offset gas system.

Figure 16:
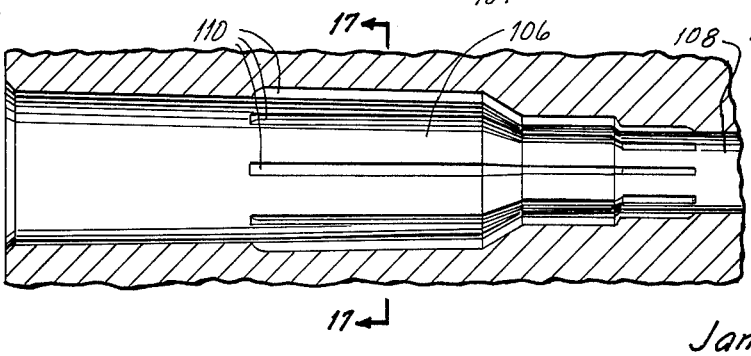

FIG. 16 is a partial cross-sectional elevation view of the firearm modified with a fluted chamber.

Figure 17:
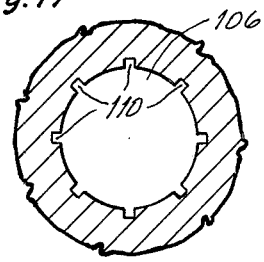

FIG. 17 is a cross-sectional end view of the fluted chamber taken along line 17—17 of FIG. 16.

Similar reference characters refer to similar parts throughout the several views of the drawing.

Referring now to the drawings in detail, particularly FIG. 1, the firearm is designated as 10 and includes a frame 12 housing a reciprocally mounted bolt 14 and barrel 16. Barrel 16 includes a barrel abutment 18 slidably received within an elarged cylindrical chamber 20 of frame 12. A barrel spring 24 or barrel biasing means is disposed between abutment 18 and a forward end wall of frame 12 to bias abutment 18 of barrel 16 against an annular posterior chamber wall 26 of chamber 20. When abutment 18 is against chamber wall 26, the barrel is in its rearward position; also hereafter designated as a first position.

A conventional cartridge extractor 28 and firing pin 30 are contained on the forward end of bolt 14. Disposed between the rear wall of the frame and the bolt is bolt drive spring 32 for driving the bolt forwardly against the barrel. This driving spring is designed to drive the bolt forwardly and cause the bolt to reach a velocity just before closing equal to approximately one-half that which would be normally reached if the firearm where fired from a closed bolt position. That is, the bolt is given a momentum equal to one-half of the firing recoil momentum of the cartridge being fired. Between the bolt and the barrel is a conventional cartridge supply magazine 34 or other cartridge supply means for supplying cartridges to the bolt as it moves forwardly. A customary sear 36, sear spring 38 and trigger 40 contain bolt 14 in a cocked position in a manner which is obvious and conventional. When bolt 14 is cocked, bolt drive spring 32 is in a compressed condition.

Figure 3:
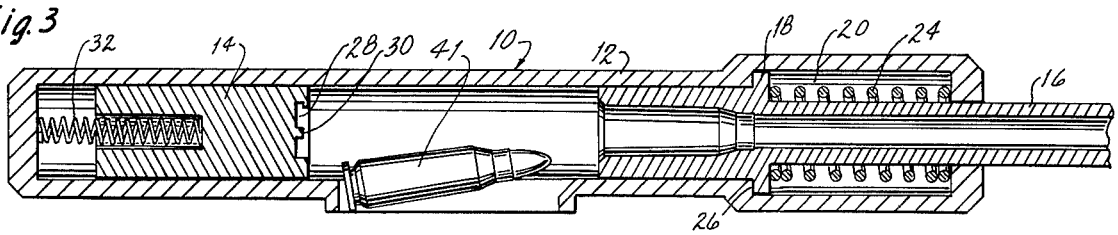
Figure 4:
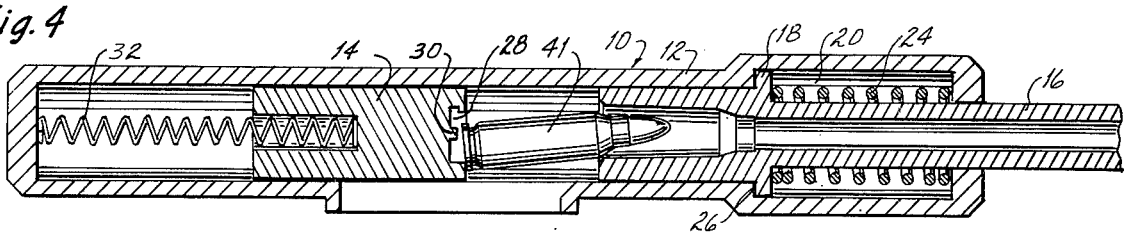
Figure 5:
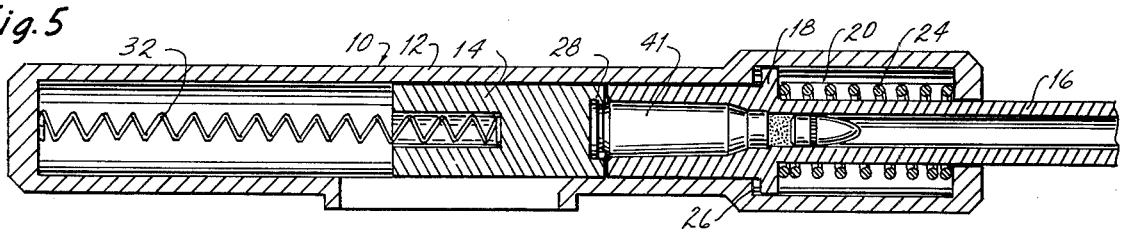
Figure 6:
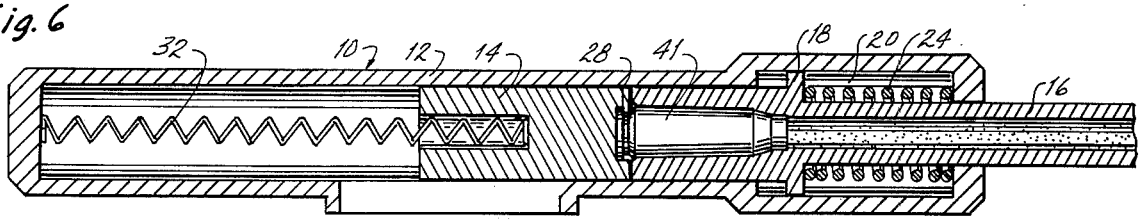

The operation of the firearm will now be described following the operation sequence of FIGS. 3 through 8. The firearm is prepared to be fired by cocking bolt 14 and holding the bolt against the force of driving spring 32 by sear 36 (FIG. 3). The gun is fired by releasing sear 36 with trigger 40. Once the sear is released, bolt 14 moves forwardly picking up a cartridge 41 from supply magazine (FIG. 4) and inserts the cartridge into the barrel's chamber. When the cartridge is finally seated and the bolt contacts or impacts against the barrel, as shown in FIG. 5, firing pin 30 fires the cartridge. It should be noted that alternatively the bolt can be designed to impact on the cartridge case, and through the cartridge case, against the barrel.

Impact of the bolt on the barrel drives the barrel forwardly. The bolt and barrel are designed so that this impact is non-resilient, that is the bolt and barrel do not rebound apart after impact. This design is necessary to maintain the bolt and barrel in a locked position from the moment of firing until the high firing pressure developed by the propellant gas is reduced. Some of the factors which are considered in this design are the dampening effect of the cartridge entering the chamber and in forcing the projectile into initial engagement with the rifling, the mechanical effort of forcing the extractor over the rim of the cartridge and the subsequent engagement of the extractor with the cartridge. A spring or other dampening means may be provided between the bolt and barrel to further insure a non-resilient impact.

Figure 7:
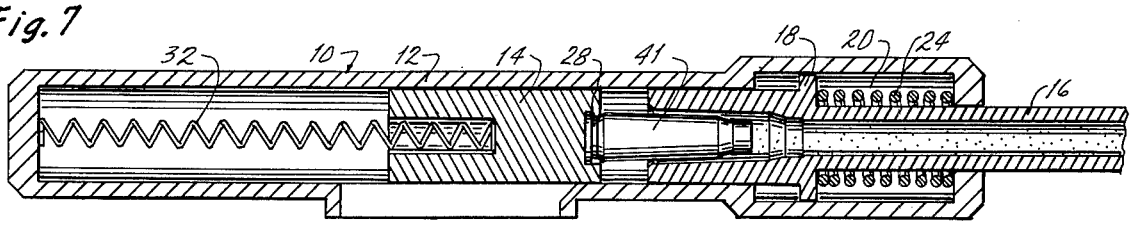
Figure 8:
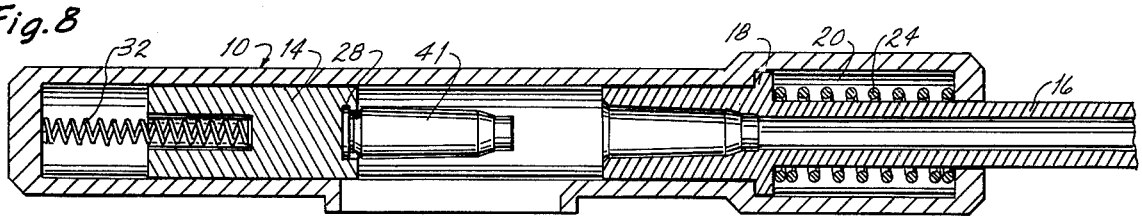

The bolt has a velocity on impact to give its mass a forward momentum equal to approximately one-half the recoil momentum of the particular cartridge being fired. The result is that one-half of the recoil momentum from firing is utilized in arresting the bolt's forward movement and one-half, or the remainder, is utilized in returning it to its rearward position. The masses of the bolt and barrel are also designed such that as the bolt impacts against the barrel and moves it forwardly against the barrel spring, the barrel and bolt remain together during their forward movement until the gas pressure in the barrel's chamber is sufficiently reduced to allow the cartridge to be extracted without being ruptured or unduly stretched. At this point, shown in FIG. 6, the bolt's forward motion has been arrested by the gas pressure which then reverses and accelerates the bolt rearwardly. However, barrel 16 continues in its forward movement for a short distance until arrested by barrel spring 24. This position (as seen in FIG. 7) is hereafter referred to as the barrel's forward or second position. Thereafter, as seen in FIG. 8, the barrel spring returns the barrel to its rearward position and the cartridge case is ejected in a conventional manner as the bolt moves rearwardly.

The bolt is held by the sear upon reaccing the full recoil position if the firearm is to be of the semi-automatic variety, in which case the firearm has returned to the position it was in before being fired. If the weapon is to be fully automatic, the bolt is simply permitted to return forwardly and repeat the cycle. With correct spring design, the spring energy capacity of bolt spring 32 and barrel spring 24 is sufficient to prevent either the bolt or barrel from having metal to metal impact with the frame while the cartridge is being fired. Therefore, since the recoil momentum acts only on the springs, not on the frame, the stability of the firearm is improved.

In the above embodiment, as described, the initial separation of the bolt and barrel results as much from the continuing forward motion of the barrel as to the rearward recoil of the bolt. Thus, if the forward motion of the barrel can be retarded and arrested, or possibly reversed, at the time the bolt begins its rearward movement, instead of separating from the bolt, the barrel would remain effectively locked to it. Thus, since the bolt remains with the barrel for a longer period of time the cartridge would be supported even during the time when there is relatively a low pressure in the barrel and any tendency of the system to stretch the cartridge case would be prevented.

One method of extending the duration of the locking effect of the barrel and bolt is by modifying the barrel spring. In this modification, the barrel mass and the barrel spring rate are designed so as to cause the barrel to have a particular natural frequency of vibration in conjunction with the barrel spring. This fixed frequency of vibration is designed such that the time period corresponding to one-half of the complete oscillation of the barrel is approximately equal to the duration of the pressure period within the chamber of the weapon. Thus, when the firearm is fired, the spring will assist in retarding the forward motion of the barrel but will also reverse and move the barrel rearwardly when the bolt moves rearwardly. Thus, the time length during which the bolt will be locked to the barrel is substantially extended. Since the locking effect is extended, the cartridge case is supported by the bolt for a longer period of time or until the pressure in the barrel's chamber further subsides. This causes the cartridge case to be extracted after the pressure within the barrel's chamber has subsided to a low level, and accordingly, the tendency for the cartridge case to stretch is substantially eliminated.

Figure 2:
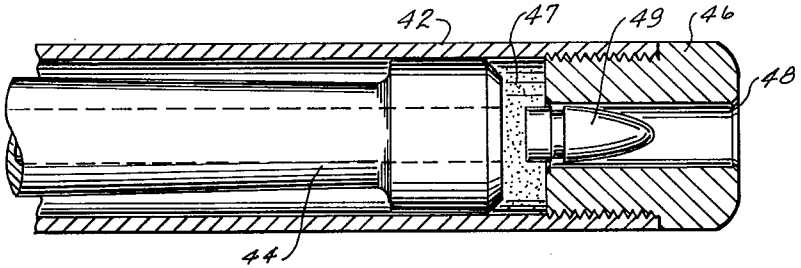
FIG. 2 is a partial cross-sectional view of the firearm modified with a muzzle booster.

In a second modification, another method of prolonging the locking effect of the barrel and bolt is shown. In this modification a muzzle gas system is utilized as seen in FIG. 2. The firearm is the same as the embodiment shown in FIG. 1 with the exception that the frame 42 of the firearm extends forwardly of the barrel 44 and has a frame end wall 46 threadably secured to its forward end. This end wall 46 has a cylindrical opening 48 slightly larger than the projectile 49 to allow the projectile to pass through the opening without interference.

In operation, as the projectile leaves the barrel, the pressure of the gas 47 expelled at the barrel's muzzle between the barrel and end plug 46 assists the barrel spring 24 (FIG. 1) to decelerate the forward motion of the barrel to keep it locked to the bolt. The gas pressure also assists the barrel spring to move the barrel rearwardly at the same time the bolt moves rearwardly. Thus, the tendency of the barrel to separate from the bolt by moving forwardly while the bolt is stopped and reversed is reduced. Since the bolt remains locked with the barrel for a longer period of time, as discussed in relation to the previous modification of the barrel spring with a fixed natural frequency of vibration, the cartridge case is extracted at a lower chamber pressure which substantially eliminates the possibility of the cartridge case being unacceptably stretched. Other than this, the firearm operates the same as described for the first embodiment shown in FIG. 1.

In a third modification, instead of using a barrel spring to arrest the forward movement of the barrel and return the barrel to its rearward position, a gas system is provided. Referring to FIG. 9 which shows one embodiment of this modification, a concentric ported gas system, the barrel is formed with an annular barrel shoulder 50 which reciprocally rides in a cylindrical chamber 52. The chamber is formed by the barrel in combination with an annular rearward wall 54 and an annular forward wall 56 of frame 58. The forward portion of the chamber between barrel shoulder 50 and forward wall 56 is hereafter referred to as an expansible pressure chamber 59. Immediately forward of barrel /shoulder 50 are a series of gas ports 60 arranged around the barrel's circumference for passing high pressure gas from the barrel to expansible pressure chamber 59. A relatively weak barrel spring 62, located forwardly of chamber 59, is substituted for the stronger barrel spring 24 of the first embodiment shown in FIG. 1.

In operation of the firearm utilizing this gas system, the gun is fired exactly as described in the first embodiment. That is, the bolt is released from the sear and projected forwardly against the chamber of the barrel by the bolt barrel spring 32 (FIG. 1). The barrel is initially in a rearward position with barrel shoulder 50 abutting annular wall 54. As the bolt closes against the barrel and fires the cartridge, a portion of the high pressure propellant gases from the bore escape through ports 60 into pressure chamber 59. The gas is tapped from the barrel at a position as close as possible to the barrel's chamber to allow the gas pressure to act on the barrel as soon as possible after firing. As the gas pressure enters into pressure chamber 52, it acts on barrel shoulder 50 to first arrest or retard the forward motion of the barrel and then return the barrel to its rearward position. Forward barrel spring 62, a relatively weak spring, is only utilized to insure that the barrel is in its rearward or first position at the start of the firing cycle. The advantage of utilizing a gas system is that the gas pressure in the system applies force in proportion to the force being applied to the bolt through the rear of the cartridge. This enables the locking effect to be prolonged since both the bolt and the barrel are arrested in their forward movement simulataneously and then propelled rearwardly together. In fact, the locking effect can be prolonged until the firing pressure subsides to a negligible level. The bolt after separation from the barrel continues to be propelled rearwardly by the gas against the bolt spring exactly as previously described. It is essential that the system be arranged to have a minimum initial volume when the barrel is in its rearward position to insure the most rapid and accurate matching of the bolt's acceleration. In this modification the masses of the bolt and barrel and the momentum imparted to the bolt are designed to insure that recoil momentum is utilized in arresting the forward movement of both the barrel and bolt and in returning them to their initial positions. As in the previous embodiments, stability of the firearm is improved since the recoiling parts "float" in the frame and metal to metal impact with the frame is eliminated.

In another embodiment of the gas system, as shown in FIG. 10, instead of a concentric ported gas system of FIG. 9, an off-center or eccentric gas system is provided. In this system the barrel supports on its lower surface a cylindrical housing 63 open at one end and communicating at its closed end with the interior of the barrel through propellant gas port 64. Slidably received within housing 63 is a piston 65 journalled on an end plug 66 threaded into the open end of housing 63. The space between the piston and the closed end of the chamber forms an expansible pressure chamber 68. The exterior end of the piston abuts against a portion of the frame 69 where the frame is enlarged to accommodate the housing. Port 64 lies immediately forward of the barrel's chamber so that propellant gas will pass into expansible pressure chamber 68 as soon as the cartridge is fired.

The operation is the same as described for the concentric ported gas system. When the bolt impacts against the barrel and the cartridge is fired, propellant gas passes through port 64 into pressure chamber 68. By acting on the closed end of housing 63, the pressure of the gas first arrests the forward movement of the barrel and returns it to its original rearward position.

In a fourth modification seen in FIG. 11, the firearm is modified to be fired from a closed bolt position. The operational sequence of this modification may be seen by referring to FIGS. 12, 13 and 14.

Referring first to FIG. 11, a barrel is reciprocally mounted in frame 72 as in the first embodiment, but barrel spring 24 (FIG. 1) is eliminated. Similar to the modification shown in FIG. 10, the bottom portion of the barrel is cast with a cylindrical housing 74 having a closed end and open end threaded to an end plug 76. End plug 76 contains a central opening to journal a piston 78. The space between the closed end of housing 74 and piston 78 defines an expansible pressure chamber 80 which is in communication with the interior of the barrel through opening or port 82. The port opens into the interior of the barrel immediately forward of the barrel's chamber to enable propellant gas to pass into pressure chamber 80 as soon as a cartridge is fired. Frame 72 of the firearm is enlarged to allow housing 74 to reciprocally ride in the frame and the exterior end of the piston abuts against the frame where shown. A stepped shoulder or wall 84 of the frame limits the rearward movement of the barrel. To bias the barrel forwardly barrel spring 86 is disposed between the frame and housing 74.

In operation, the components are in proper relationship for firing as shown in FIG. 13. At this time, barrel spring 86 biases barrel housing 74 against piston 78. This is the forward or first position of the barrel. After bolt 88 is closed against the barrel, the trigger, not shown, of the firearm is triggered causing the bolt's firing pin to fire the cartridge in a conventional manner. When the cartridge is fired, gas pressure escaping into the compression chamber acts on the closed end of housing 74 causing the barrel to move rearwardly. The gas system is designed to exert a sufficient rearward force on the barrel to overcome various forces which tend to move the barrel forwardly such as the initial engraving of the rifling into the forwardly moving projectile, the projectile friction force and if a necked type cartridge is used, the forward force exerted by the gas pressure on the shoulder of the cartridge. The system is also designed to accelerate the barrel's mass rearwardly at a rate equal to the rearward acceleration of the bolt which is accelerated rearwardly by propellant gas pressure acting on the rear of the cartridge. Since the gas pressure does force the barrel back at a rate equal to the rearward acceleration of the bolt, the barrel and bolt are effectively "locked" together during their rearward movement. This locking effect is designed to continue until the pressure within the chamber of the barrel subsides sufficiently to allow the cartridge to be extracted. At this time, the barrel stops when arrested by barrel spring 86 (FIG. 14) which is the barrel's rearward or second position. The bolt however continues to be propelled to the rear, as seen in FIG. 16, until the gas pressure subsides. The cartridge is ejected from the weapon in a conventional manner on the bolt's rearward stroke. After the gas pressure subsides barrel spring 86 returns the barrel to its forward position and bolt drive spring 90 returns the bolt against barrel 70. The bolt receives and inserts a cartridge into the chamber of the barrel on its forward stroke whereupon the firearm is again ready to be fired.

Obviously the advantages of the differential recoil system as mentioned in the preferred embodiment and modifications thereof is lost. However, this closed bolt gas system is of value to prevent the cartridges from being overly stretched when closed bolt firing is desired.

Instead of an off-center compression chamber, the closed bolt gas system may be provided with a concentric pressure chamber shown in FIG. 15. In this system similar to the structure shown in FIG. 9, the barrel is formed with an annular barrel shoulder 92 which reciprocally rides in a cylindrical chamber 94 formed by the barrel in combination with an annular rearward wall 96 and a threaded annular forward end wall 98 of frame 100. The forward portion of the chamber between barrel shoulder 92 and forward wall 98 is hereafter referred to as an expansible pressure chamber 102. Immediately forward of barrel shoulder 92 are one or more gas ports 104 arranged around the barrel's circumference for passing high pressure gas from the interior of the barrel to pressure chamber 102. Ports 104 lie immediately forward of the barrel's chamber to insure that propellant gas pressure will be received in pressure chamber 102 as soon as the cartridge is fired.

As an additional means to insure that a cartridge case is not stretched beyond an acceptable range, a fluted barrel chamber may be employed with any of the above embodiments or modifications thereof. As seen in FIGS. 16 and 17, chamber 106 of the barrel 108 is cut with shallow longitudinal flutes 110 disposed along the forward portion of the barrel's chamber. The drawing for clarity, exaggerates the depth and width of the flutes 110. Being that the chamber is fluted, propellant gas pressures act both on the interior and exterior of the forward position of the cartridge case where the flutes are located. This substantially reduces the cartridge area over which the internal firing pressure acts to force the cartridge against the chamber wall. The adherence of the cartridge case to the wall during high firing pressure is accordingly lessened.

Although the firing means for the above embodiments and modifications thereof consisted of a conventional firing pin on the end of the bolt, it should be understood that other conventional means of firing the cartridge may be employed such as electric primed ammunition or a mechanically actuated firing pin.

It should be evident from the above description that a novel firearm has been developed which has a number of distinct advantages over the prior art. The firearm utilizes an operating system which provides for effective locking and operating energy supply without the use of a conventional locking system and energy supply system. That is the barrel and bolt are in mechanically free contact. This is accomplished by designing a blowback bolt with a particular mass and closing velocity and a reciprocating barrel with a particular mass. These components are designed such that the bolt impacts against the barrel without rebound and drives it forwardly while remaining in close contact with the barrel until high firing pressure within the barrel's chamber substantially subsides. Since the bolt supports the rear of the cartridge case during the period of high firing pressure, the cartridge does not stretch or fracture and malfunctions of that type are eliminated. The bolt's momentum at impact with the barrel is approximately one-half of the firing recoil momentum of the cartridge being fired. One-half of the recoil movement is therefore utilized to arrest the forward movement of the bolt and the remaining half to drive the bolt back to its rearward position. A barrel spring first arrests the forward movement of the barrel and then returns the barrel to its initial position. This enables the gun to be extremely stable even when firing high powered ammunition since there is no metal to metal impact with the frame.

Several modifications of the invention are provided. One of these modifications uniquely uses a barrel and barrel spring combination which is designed to cause the barrel to have a natural frequency of vibration against the barrel spring such that the barrel spring will move the barrel rearwardly simultaneously with the bolt to extend the time during which the barrel and bolt are effectively locked together. Since the time is extended, gas pressure within the chamber has even further subsided when the cartridge is finally extracted. In another modification, a similar result may be utilized with a muzzle booster in which gases are trapped between the barrel and the frame to retard the forward movement of the barrel and move it rearwardly with the bolt. The firearm may also easily be adapted with gas system in lieu of the barrel spring to retain the same advantages. Further still, if it is desirable, to use the firearm with a closed bolt firing position, the firearm may be modified with a gas system which causes the barrel to move rearwardly with the bolt until firing pressure in the chamber has sufficiently subsided to extract the cartridge without undue stretching. The firearm is extremely simple, utilizing a minimum of operating parts. Because of its simplicity, the firearm is easy to field strip and repair as well as being very practical and economically feasible to manufacture.

For simplicity and ease of understanding the inventive characteristics of the firearm, the firearm and its various modifications have been illustrated in the drawings with only the essential operating parts exposed. Also, the exact nature of the assembly of the firearm, other than that described, has also been omitted where considered obvious and not germane to the invention. For example, in FIG. 1 is should be obvious that a provision must be made in frame 12 to remove or insert barrel 16. One such obvious provision would be to thread the frame's end wall. In such obvious instances, although omitted, it should be understood that the firearm is designed to enable its various parts to be assembled and disassembled.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawing shall be interpreted as illustrative and not in a limiting sense.

It is to be understood that the following claims are intended to cover all of the generic and specific features of the invention herein described, and all statements of the scope of the invention which, as a matter of language, might be said to fall therebetween.

Now that the invention has been described:

What is claimed is:

1. A firearm comprising: A frame, a bolt reciprocally mounted along the longitudinal axis of said frame, a barrel reciprocally mounted along the longitudinal axis of said frame between a first and second position, said bolt having a cartridge receiving means for receiving and inserting a cartridge in the chamber of said barrel and a cartridge extracting means for extracting said cartridge after being fired, firing means for firing said cartridge, a bolt drive spring disposed to drive said bolt forwardly, barrel biasing means to bias said barrel toward said first position, cartridge supply means for supplying a cartridge to said bolt, said bolt arranged to receive the cartridge on its forward stroke and afterwards insert the cartridge into the chamber of said barrel, said cartridge fired when in said chamber by said firing means, said bolt being biased into operative engagement with said barrel when said cartridge is fired, said bolt and said barrel in mechanically free engagement relative to each other, a gas system means for controlling the movement of said barrel relative to said frame, said gas system means including at least one propellant gas port in said barrel adjacent to the forward end of the chamber of said barrel, said gas system means further including an expandable compression chamber, said expandable cmpression chamber disposed between a portion of said barrel and a portion of said frame, said compression chamber in communication with said propellant gas port whereby when said cartridge is fired, propellant gas enters said compression chamber to act on said barrel portion to initiate rearward movement of said barrel relative to said frame, said bolt moving rearwardly under the force of said cartridge such that the initial relative motion between said bolt and said barrel is substantially zero whereby said bolt and said barrel remains in mechanically-free contact during at least a portion of the rearward movement.

2. The firearm of claim 1 wherein said barrel portion comprises a concentric barrel shoulder integral with said barrel, said shoulder reciprocally riding in a cylindrical opening between said barrel and forward and rearward annular walls of said frame, said expansible compression chamber formed between said shoulder and the forward annular wall of said frame.

3. The firearm of claim 1 wherein said barrel portion comprises: a cylindrical barrel housing carried by said barrel, said housing parallel to the longitudinal axis of the said barrel, said housing closed at its rearward end, a piston riding in said housing, one end of said piston contacting said frame, and said expansible compression chamber formed between said closed end of said housing and said piston.

4. The firearm of claim 1 wherein said frame extends forwardly to said barrel, said frame having a forward end wall adjacent the forward end of said barrel, said end wall having an opening to pass a projectile from said barrel, firing gases from firing said projectile acting on the end of said barrel to assist in arresting the forward movement of the barrel and moving the barrel rearwardly with the bolt to enable said bolt and barrel to continuously remain in mechanically free contact during their forward movement and at least a portion of their rearward movement.

5. The firearm of claim 4 wherein longitudinal flutes are disposed in said chamber to substantially balance the firing pressure on both sides of the cartridge.

6. The firearm of claim 1, said firearm being fired from a closed bolt position, said barrel being forward when in said first position, an opening in said barrel adjacent the forward end of the chamber of the barrel for passing propellant gases, said opening in communication with an expansible pressure chamber, said chamber including a portion of said barrel whereby when a cartridge is fired propellant gas pressure acts on said barrel portion and simultaneously acts on said bolt through the rear of the cartridge to simultaneously move said bolt and barrel rearwardly while in said mechanically-free contact until the high firing pressure within the chamber of the barrel substantially subsides.

7. The firearm of claim 6 wherein longitudinal flutes are disposed in said chamber to substantially balance the firing pressure on both sides of the cartridge.

* * * * *

UNITED STATES PATENT AND TRADEMARK OFFICE

CERTIFICATE OF CORRECTION

PATENT NO. : 4,019,423

DATED : April 26, 1977

INVENTOR(S) : James H. Johnson

It is certified that error appears in the above-identified patent and that said Letters Patent are hereby corrected as shown below:

Col. 2, line 27 - U.S. Pat. No."1,144,185"
should read -- 1,144,285 --
Col. 4, line 58 - "barrels" should read
-- barrel --
Col. 5, line 28 - "Metal impact" should read
-- metal to metal impact --
Col. 7, line 13 - "operation" should read
-- operational --
Col. 7, line 66 -- "reaccing" should read
-- reaching --
Col. 9, line 21 -- eliminate "/"
Col. 13, line 42 -- "cmpression" should read
-- compression --

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*